United States Patent [19]

Kamimura et al.

[11] Patent Number: 4,936,196

[45] Date of Patent: Jun. 26, 1990

[54] DEVICE FOR RESETTING SERVO ACTUATOR TO NEUTRAL POSITION

[75] Inventors: Toshio Kamimura; Koji Ito, both of Gifu, Japan

[73] Assignee: Teijin Seiki Company Limited, Osaka, Japan

[21] Appl. No.: 275,872

[22] Filed: Nov. 25, 1988

[51] Int. Cl.[5] ..... F15B 20/00

[52] U.S. Cl. ..... 91/360; 91/363 A; 91/453; 91/459

[58] Field of Search ..... 60/403, 404, 405, 406, 60/469; 91/358 A, 360, 363 A, 453, 459

[56] References Cited

U.S. PATENT DOCUMENTS

| | | | |
|---|---|---|---|
| 2,773,660 | 12/1956 | Rasmussen | 91/363 A |
| 2,819,030 | 1/1958 | Christensen | 91/363 A |
| 2,824,712 | 2/1958 | Rasmussen et al. | 91/363 A |
| 2,973,013 | 2/1961 | Myers | 91/363 A |
| 4,601,169 | 7/1986 | Hesse et al. | 60/406 |

*Primary Examiner*—Edward K. Look

*Attorney, Agent, or Firm*—Finnegan, Henderson, Farabow, Garrett, and Dunner

[57] ABSTRACT

A neutral position resetting device for a servo actuator is described, having reset means that is actuated when the control of the servo actuator by actuator valve means becomes inoperative. The reset means ordinarily separated from a spool of the actuator valve means resets the servo actuator to a neutral position by applying a driving force and forcibly moving the spool.

7 Claims, 9 Drawing Sheets

DEVICE FOR RESETTING SERVO ACTUATOR TO NEUTRAL POSITION

BACKGROUND OF THE INVENTION

1. Field of the Invention

The present invention relates to a device for resetting a servo actuator to its neutral position.

2. Description of the Related Art

Generally, a high degree of safety is required in an aircraft. Backup control systems are required so that, should one control system fail, other control systems can take over the impacted control function, thereby ensuring safe continuation of flight. However, there are cases where flight safety may be hampered if a control system develops a failure and is left in the condition at the time of the failure. When this occurs, there must be a capability to reset the failed control system to a neutral position, thereby not adversely affecting the flight.

Prior art control systems of this type have included a neutral position resetting device, which functions to reset a servo actuator for controlling an airfoil to a neutral position, when a failure in the actuator has developed. As shown in FIG. 17, this device comprises a servo actuator 3 whose rod 1 is linked with an airfoil 2. Servo control is effected by supply and discharge of oil pressure to and from the servo actuator 3 via an ordinary servo valve 4 and a switching valve 5. The quantity and direction of the oil pressure to be supplied to and discharged from the servo actuator are controlled by shifting a spool 6 of the servo control valve 4 with a motor 7, based on a signal sent from the cockpit. If it becomes impossible to control the servo actuator 3 because of a failure in the motor 7 or the servo control valve 4, the air foil 2 will be locked at a certain position which will adversely affect the flight. When such a situation develops, a solenoid valve 8 is actuated, causing switching valve 5 to be switched to the opposite direction. As a result, oil pressure supplied to or discharged from the servo actuator 3 via a control valve 9 acts to reset the piston rod 1 of the servo actuator 3 to a neutral position, thereby freeing the airfoil 2 from adverse affects.

In such a prior art neutral position resetting device, however, there are required two control systems, namely, a first hydraulic control system that leads from the servo control valve 4 to the servo actuator 3, and a second hydraulic control system that leads from the control valve 9 to the servo actuator 3. In addition, a switching valve 5 has to be interposed between the two systems for switching between them. This configuration has been disadvantageous in that the hydraulic circuit becomes complicated and the mechanism has to be large in scale and weight, resulting in higher production cost.

SUMMARY OF THE INVENTION

It is therefore an object of the present invention to resolve the above-mentioned problem by providing reset means for resetting a servo actuator, normally separated from the spool of the actuator valve means, which gives a driving force to the spool to forcibly move the servo actuator to a neutral position when a malfunction of the actuator valve means is caused.

This and further objects are accomplished by an apparatus for resetting a servo actuator to a neutral position comprising servo actuator moving means for moving, the servo actuator between an actuated position and the natural position, actuator valve means in fluid communication with the servo actuator moving for supplying pressurized fluid to the servo actuator moving means to cause the servo actuator moving means to move the servo actuator between the actuated position and the neutral position, the actuator valve means including a spool having a first position for supplying the pressurized fluid to the servo actuator moving means to move the servo actuator from the neutral position to the actuated position and a second position for supplying the pressurized fluid to the servo actuator moving means to move the servo actuator from the actuated position to the neutral position, and reset means responsive to a malfunction of the actuator valve means at the time that the servo actuator is in the actuated position, for moving the spool from the first position to the second position to cause the servo actuator moving means to move the servo actuator from the actuated position to the neutral position.

The manner by which the above objects and other objects and advantages of the invention are attained will be apparent from the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The present invention will become more apparent from the following description of the preferred embodiments thereof, shown by way of examples, and in the accompanying drawings, in which.

DETAILED DESCRIPTION OF THE INVENTION

Figure 1:
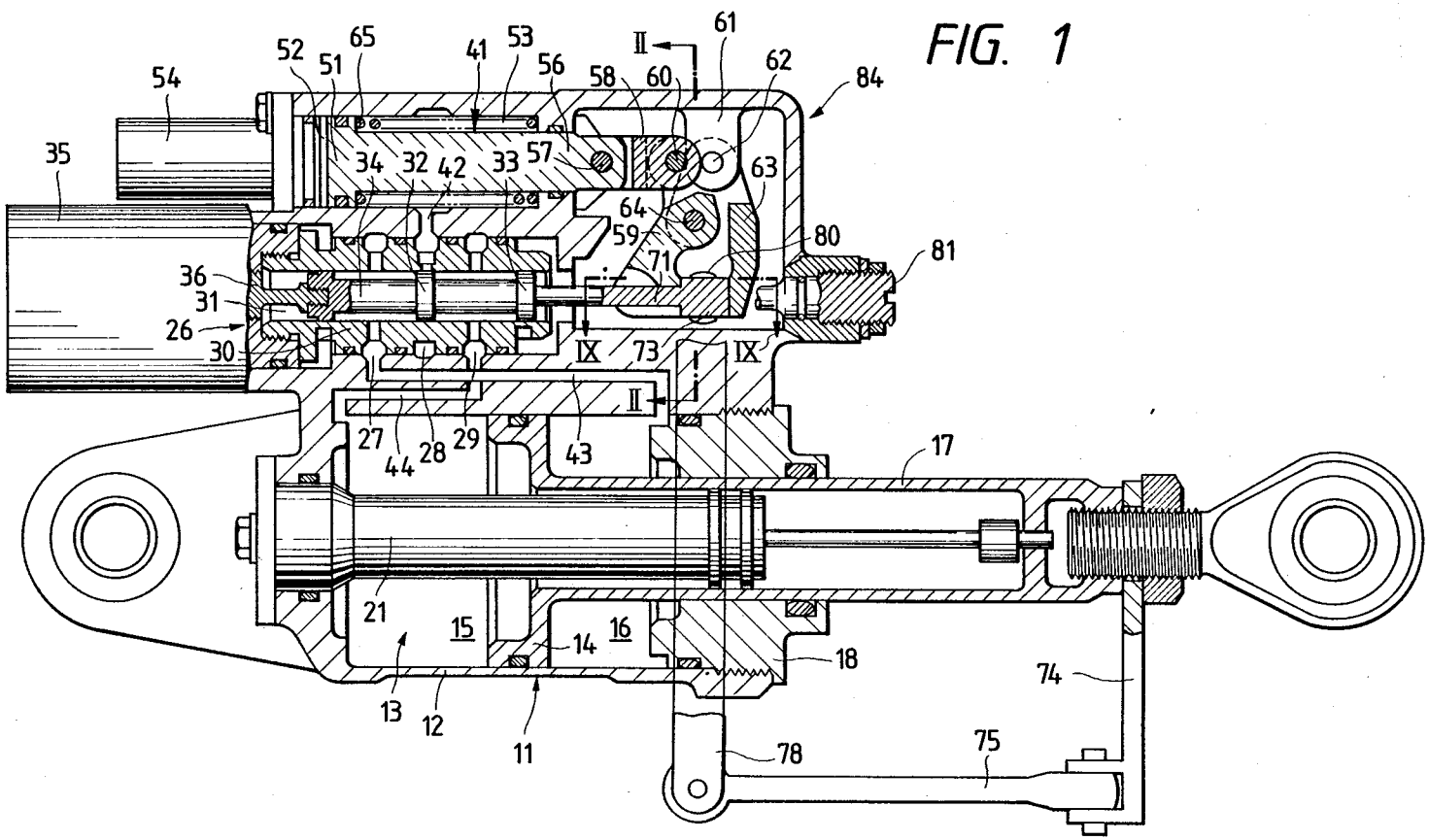
FIG. 1 is a front sectional view showing an embodiment of the present invention.

Normally, a servo actuator is controlled by a servo control valve, and resetting means are separated from the spool of the servo control valve. As described above, when control of the servo actuator become impossible due to failure in the servo control valve or the like, the resetting means is actuated to impart a force in the axial direction of the spool of the servo control valve, thereby forcing the spool in the direction that causes the servo actuator to return to a neutral position. As a result, the servo actuator is returned to a neutral position, for example, when the actuator is used for controlling the airfoil of an aircraft, to a position for which the airfoil will not adversely affect the flight of the aircraft. In the present invention, the servo actuator is reset to a neutral position by the direct shifting of the spool of the servo control valve. Therefore, the mechanism of the system is simplified, its scale and weight can be reduced, and further, the manufacturing cost can be reduced. Moreover, if the failure of the servo control valve is developed by impact of a foreign object into the spool, the foreign object can be fragmented by the shifting of the spool in the direction of its axis so that the servo control valve can be easily returned to the normal position.

Referring to the drawings one embodiment of the present invention will be described in detail in the following.

Figure 2:
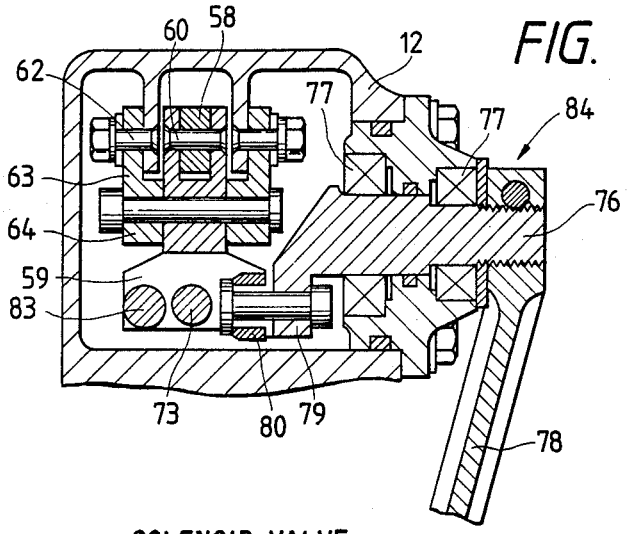
FIG. 2 is an enlarged sectional view as seen in the line II—II of FIG. 1.
Figure 3:
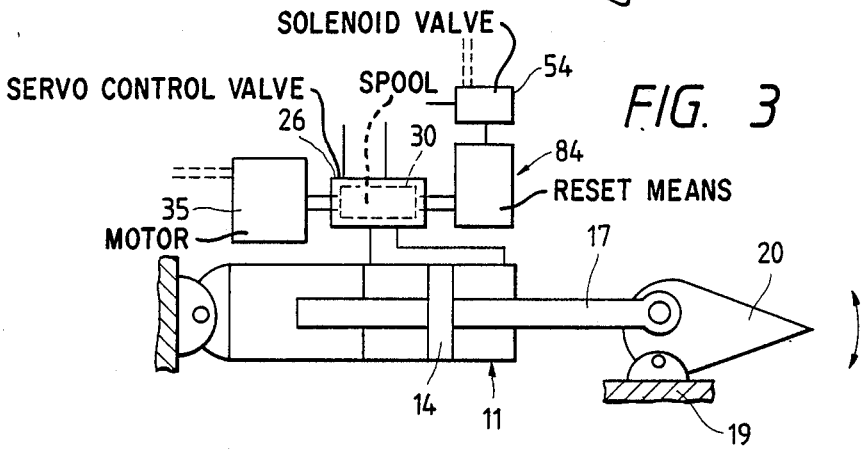
FIG. 3 is a schematic overall diagram of the present invention.
Figure 4:
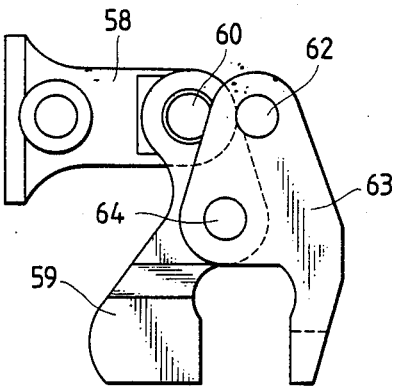
FIG. 4 is a front view of the present invention in the vicinity of the reset pawls.
Figure 5:
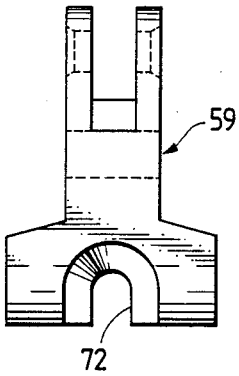
FIG. 5 is an enlarged side view of one of the reset pawls shown in FIG. 1.
Figure 6:
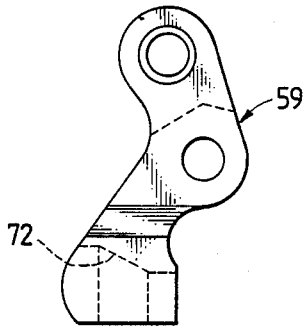
FIG. 6 is an enlarged front view of the reset pawl of FIG. 5.
Figure 7:
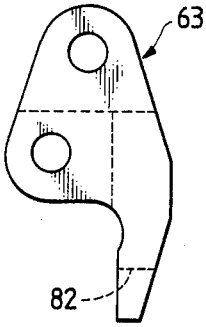
FIG. 7 is an enlarged front view of the other reset pawl of FIG. 5.
Figure 8:
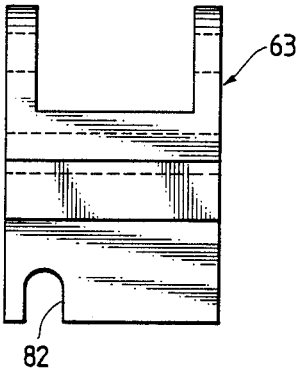
FIG. 8 is an enlarged side view of the reset pawl of FIG. 7.
Figure 9:
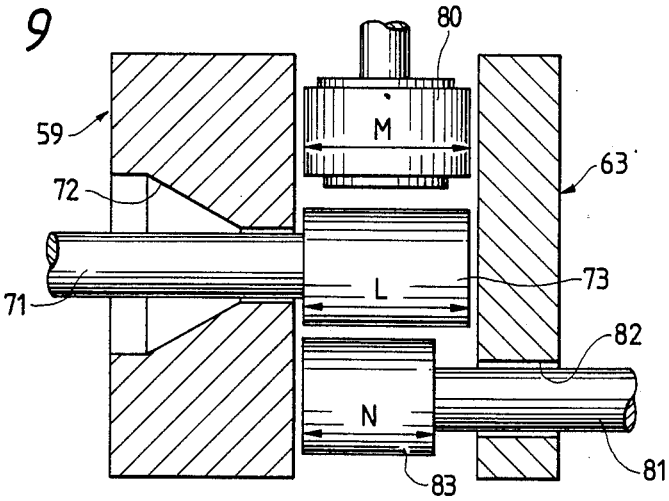
FIG. 9 is an enlarged sectional view as seen in the IX—IX line of FIG. 1.
Figure 10A:
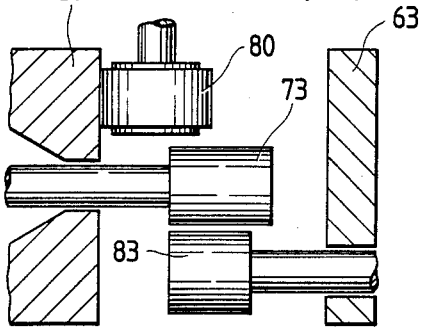
FIG. 10(*a*) to FIG. 10(*e*) are explanatory diagrams for illustrating the operation of the present invention.
Figure 10B:
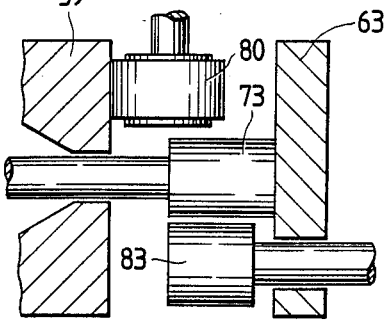
Figure 10C:
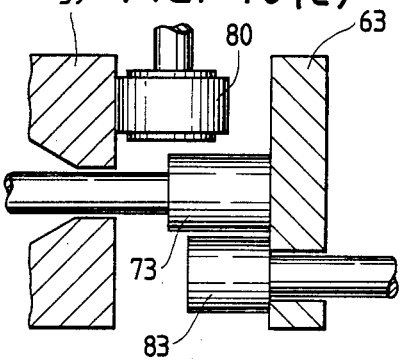
Figure 10D:
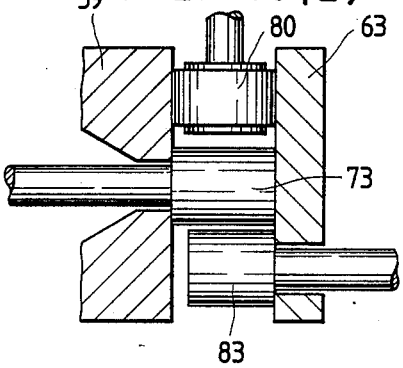
Figure 10E:
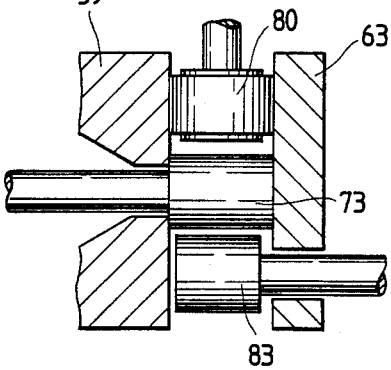

In FIG. 1 to FIG. 3, reference numeral 11 shows a servo actuator for use in an aircraft and the like. The servo actuator 11 has a piston 14 slidably housed in a chamber 13 of a casing 12. The piston 14 partitions the chamber 13 into a first chamber 15 and a second chamber 16. A piston rod 17, formed integrally with the piston 14, penetrates through a cap 18 screwed into the casing 12, and its tip is linked to an airfoil 20 supported rotatably by a fuselage 19. Reference numeral 21 shows a position detector that detects the position of the piston 14. The servo actuator 11 is servo-controlled by a feedback signal from the position detector 21.

A servo control valve 26 is housed within the casing 12. The servo control valve 26 controls the quantity and the direction of the oil pressure to be supplied to and discharged from the servo actuator 11. The servo control valve has a sleeve 30 wherein first, second and third ports, 27, 28 and 29, respectively, are disposed. First, second and third lands, 31, 32 and 33, respectively, are also slidably housed within the sleeve 30.

Reference numeral 35 shows a motor which has a moving piece 36 connected to a spool 34. The moving piece 36 of the motor 35 is moved in the axial direction by an electrical signal from a cockpit of the aircraft, thereby switching the servo control valve 26 by moving the spool 34 in the axial direction. Within the casing 12, a substantially cylindrical chamber 41 is disposed in parallel with the spool 34. Pressurized oil is supplied to the cylindrical chamber 41 from a pump which is not shown in the figure. The cylindrical chamber 41 and the second port 28 are connected with a passage 42. Similarly, the first port 27 and second chamber 16 and the third port 29 and the first chamber 15 are connected with the passages 43 and 44, respectively.

Reference numeral 51 is a piston slidably housed in the cylinder chamber 41. The piston 51 partitions the cylindrical chamber 41 into a first chamber 52 and a second chamber 53. Reference numeral 54 is a solenoid valve fixed to the casing 12. The solenoid valve 54 directs the pressurized oil to the first chamber 52 under normal conditions, but in an abnormal situation where control of the servo actuator 11 by the servo control valve 26 is inoperative, it connects the first chamber 52 to the low pressure side by being actuated and switched by another electrical signal from the cockpit.

At the tip of a piston rod 56 and formed integrally with the piston 51, there is coupled a link 58 via a pin 57 as shown in FIGS. 1, 2, 4, 5, 6, 7, 8, and 9. One end of a first reset pawl 59, which functions as one of the reset bodies, is coupled to the link 58 via a pin 60. To a bracket 61 fixed to the casing 12 there is coupled via a pin 62 one end of a second reset pawl 63, which functions as the other reset body. The central part of the second reset pawl 63 and the central part of the first reset pawl 59 overlap with each other and are linked by a pin 64. Reference numeral 65 shows a spring enclosed within the second chamber 53. The spring 65 energizes the solenoid valve toward the piston 51. Under normal conditions, the piston rod extends such that the other ends of both of the reset pawls 59 and 63 are mutually separated and released. However, under abnormal conditions, the piston rod is retracted, so that the other ends of the first and second reset pawls 59 and 63 are brought closer to each other to be closed.

In the spool 34, a rod 71 is integrally formed to be coaxial with the spool 34. The rod 71 penetrates through a slit 72 formed in the first reset pawl 59. A cylindrical cam body 73 is provided on the tip of the rod which is situated between the first reset pawl 59 and the second reset pawl 63. Further, in the tip of the piston rod 17 there is coupled a first lever 75 parallel to the piston rod 17 via a connecting bar. Reference numeral 76 is a shaft rotatably supported by the casing 12 via a bearing 77, and one end of a second lever 78. The other end of the second lever 78 is coupled to the first lever 75, which is connected to the shaft 76. The shaft 76 has an arm 79 that extends in the radial direction. A roller 80 is supported as a moving body on the tip of the arm 79 between the first reset pawl 59 and the second reset pawl 63. The roller 80 is interlocked and moves with the piston rod 17 of the servo actuator 11. The lengths L and M (see FIG. 9) of the cam body 73 and the roller 80, respectively, are substantially equal.

Reference numeral 81 shows a stopper that is screwed into the casing 12. The tip part of the stopper 81 penetrates through a slit 82 formed in the second reset pawl 63. On the tip of the stopper 81 located between the first reset pawl 59 and the second reset pawl 63 there is provided a stopping body 83. A length N (see FIG. 9) is shorter than the length L of the cam body by the portions of the stroke of the spool 34 in both directions. The piston 51, link 58, first and second reset pawls 59 and 63, connecting bar 74, first and second levers 75 and 78, roller 80, and stopping body 83 are ordinarily separated as a whole from the spool 34 of the servo control valve 26. These constitute reset means 84, for forcibly moving the spool 34 of the servo control valve 26 by applying a driving force to the spool.

The operation of the device will now be described.

Suppose that the servo actuator 11, servo control valve 26, motor 35, and the like are operating normally. At this time, the solenoid valve 54 is not actuated so that the piston rod 56 is extended due to the pressurized oil supplied to the first chamber 52, and the first and second reset pawls 59 and 63 are released. As a result, the cam body 73 and the roller 80 are freely movable without being regulated by the first and second reset pawls 59 and 63, while the spool 34 and the reset means 84 are mutually separated. In this state, if it becomes necessary to rock the airfoil 20 upwardly, for example, a signal is sent from the cockpit to the motor 35, and the moving piece 36 and the spool 34 are moved in the direction of the second reset pawl 63. By this action, pressurized oil discharged from the pump is supplied to the second chamber 16 through the second chamber 53, passage 42, second port 28, first port 27 and passage 43, and the piston rod 17 is retracted. As a result, the roller 80 moves toward the first reset pawl 59, and the airfoil is rocked upwardly by a predetermined angle.

During the above operation, if the motor 35 develops a failure, for example, and the control by the servo control valve 26 of the servo actuator 11 becomes inoperative, a warning lamp in the cockpit will be lit. Then a signal is sent from the cockpit to the solenoid valve 54, which actuates the solenoid valve 54, so that the first chamber 52 is connected to the low pressure side. As a result, the piston rod 56 is retracted by being pressurized under the action of the pressurized oil in the second chamber 53 and the spring 65, and the first and second reset pawls 59 and 63 close with the other ends coming close to each other. During the closing process, the first reset pawl 59 is brought to a stop in the condition abutting on the roller 80 (see FIG. 10(*a*)). On the other hand, the second reset pawl 63 abuts on the cam body 73 (see FIG. 10(*b*)), and moves the cam body 73 toward the motor 35. The motion under pressure is brought to a stop when the second reset pawl 63 abuts the stopping body 83 (see FIG. 10(*c*)). Now, the length N of the stopping body 83 is shorter than the length L of the cam body 73 by the stroke portions of the spool 34 so that the servo control valve 26 is switched and the second port 28 and the third port 29 are connected to each other. As a result, the flow of pressurized oil is switched to supply the oil to the first chamber 15 through the passage 44, to cause the piston 14 of the servo actuator 11 to move toward the neutral position. Interlocked with this motion of the piston 14, the roller 80 is moved toward the second reset pawl 63, with the first reset pawl 59 also following the motion of the roller 80. Next, when the first reset pawl 59 abuts upon the cam body 73 (see FIG. 10(*d*)), the first reset pawl 59 moves the cam body 73 and the roller 80 together toward the second reset pawl 63. As a result, the second land 32 of the spool 34 gradually closes the second port 28. When the servo actuator 11 is reset completely to its neutral position, the second land 32 of the spool 34 closes the second port 28, with the servo control valve 26 being reset to the neutral position also (see FIG. 10(*e*)). When the servo actuator 11 is reset to the neutral position as in the above, the airfoil 20 stops at a position that does not adversely affect the flight of the aircraft so that the aircraft can be maneuvered safely by means of the other airfoil.

In the case where the failure is caused by an impact of a foreign object between the sleeve 30 of the servo control valve 26 and the spool 34, the failure will automatically be eliminated during movement to the neutral position since the foreign object will be fragmented by the motion forcibly given to the spool 34. Accordingly, there is no requirement for such measures as providing a doubly failsafe construction to the sleeve 30 and increasing the axial tension of the force motor 35.

Figure 11:
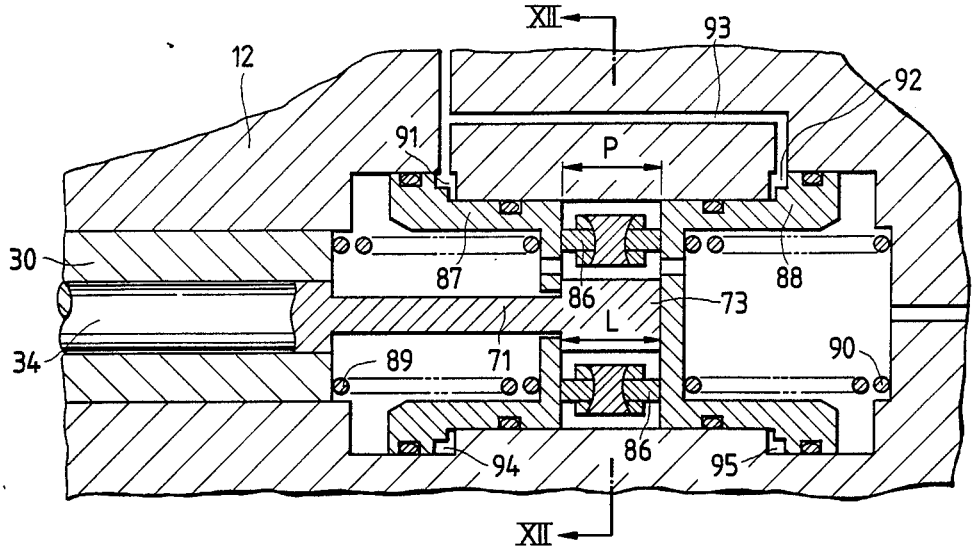
FIG. 11 is an enlarged sectional view showing part of another embodiment of the present invention.
Figure 12:
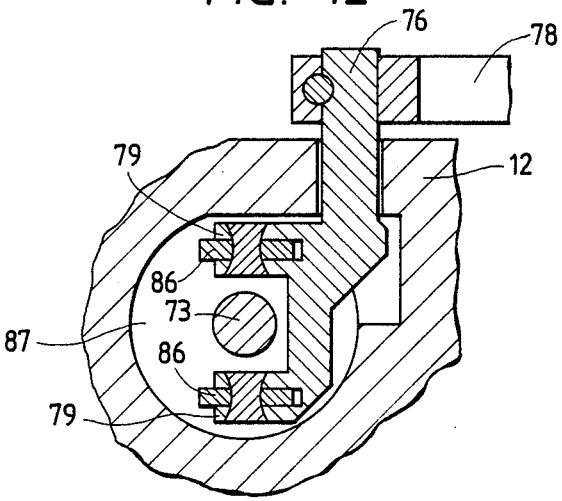
FIG. 12 is an enlarged sectional view as seen in the line XII—XII of FIG. 11.

FIG. 11 and FIG. 12 show another embodiment of the present invention. In this embodiment, two arms 79 are provided to the shaft 76, and on the tip of each of the arms 79 there is provided respectively a roller 86, as a moving body, with a length P which is equal to the length L of the cam body 73. On both sides of the rollers 86 and the cam body 73 there are provided pistons 87 and 88 as reset bodies, and further, there are provided springs 89 and 90 to energize the pistons 87 and 88, respectively, so as to come closer to each other. In addition, there are formed chambers 91 and 92 between the pistons 87 and 88, and the casing 12, and oil pressure is supplied to these chambers 91 and 92 through supply and discharge passage 93.

The pistons 87 and 88 are normally separated from each other by the supply of oil pressure to the chambers 91 and 92, without regulating the motion of the rollers 86 and the cam body 73. When the control by the servo actuator 11 by means of the servo control valve 26 becomes inoperative, the solenoid valve 54 is actuated to connect the chambers 91 and 92 to the low pressure side. As a result, the pistons 87 and 88 are moved by the energizing force of the springs 89 and 90, respectively, to come closer with each other. If it is assumed as in the foregoing that the rollers 86 move to the left while the cam body moves to the right, the piston 87 and 88 abut upon the roller 86 and the cam body 73, respectively. Then, the cam body 73 is moved to the left by being pushed by the piston 88, causing the servo control valve 26 to be switched over and causing the piston rod 17 of the servo actuator 11 to move toward the neutral piston. Next, the rollers 86 and the cam body 73 are pushed by the piston 87 to approach the neutral position, and the motion of the roller 86 and the cam body 73 is brought to a stop when the servo actuator 11 is returned to the neutral position. Here, the motion of the cam body 73 caused by the pistons 87 and 88 is stopped when the steps 94 of the pistons 87 and 88 abut upon the steps 95 of the casing 12, so that in this embodiment, the steps 95 play the same role as the stopping body 83 in the previous embodiment.

Next, there will be presented still another embodiment of the present invention.

Figure 13:
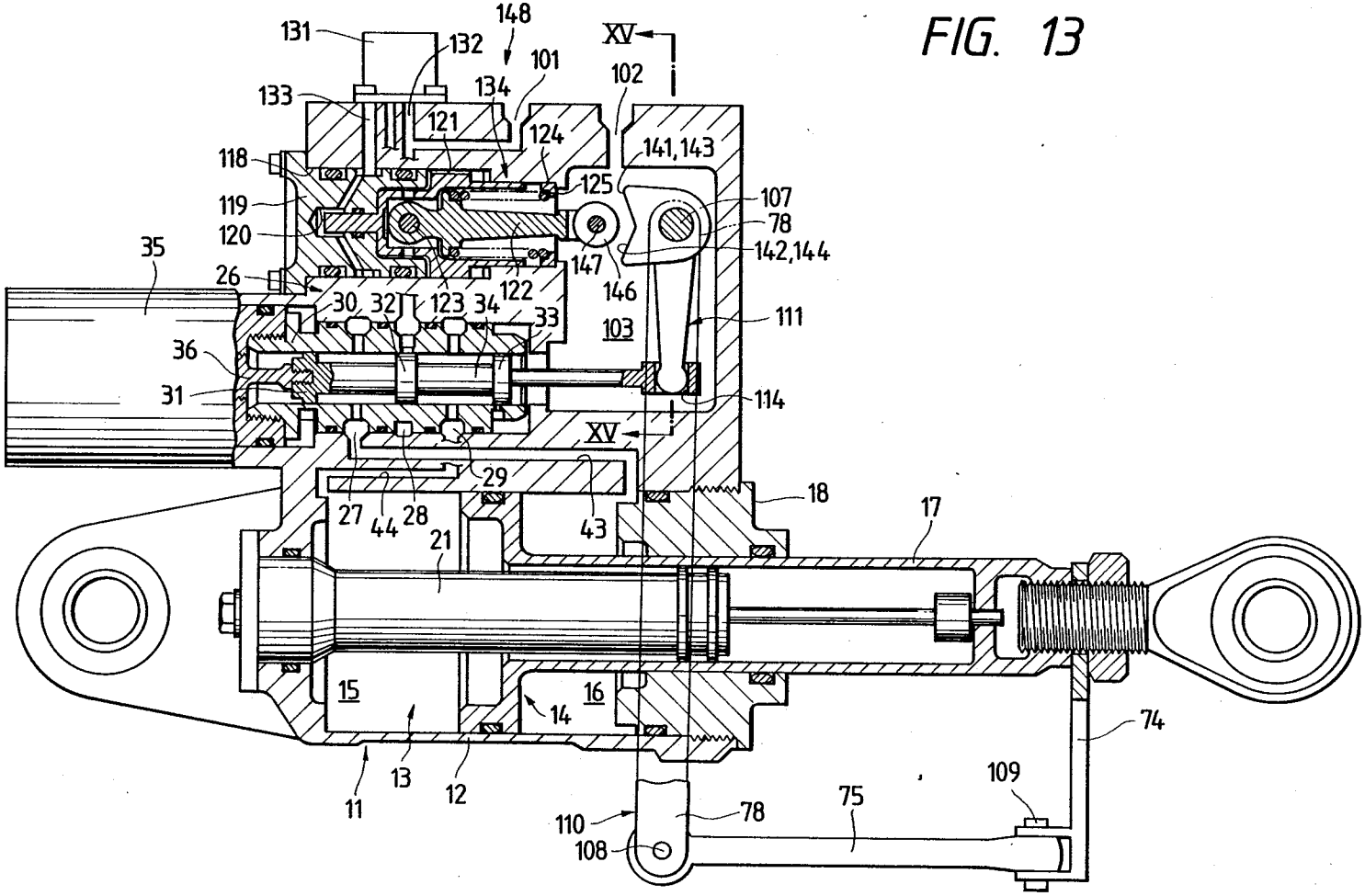
FIG. 13 is a front sectional view of still another embodiment of the present invention.
Figure 14:
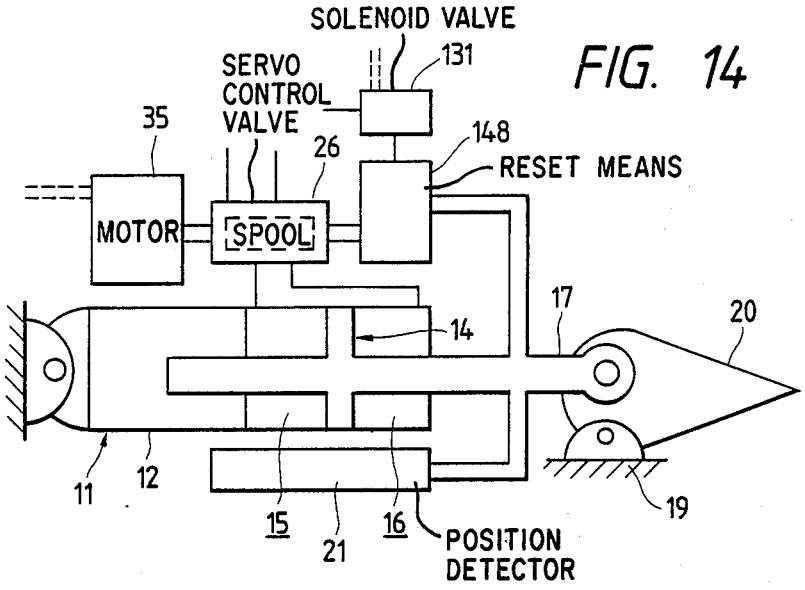
FIG. 14 is a schematic overall diagram of the device in FIG. 13.
Figure 15:
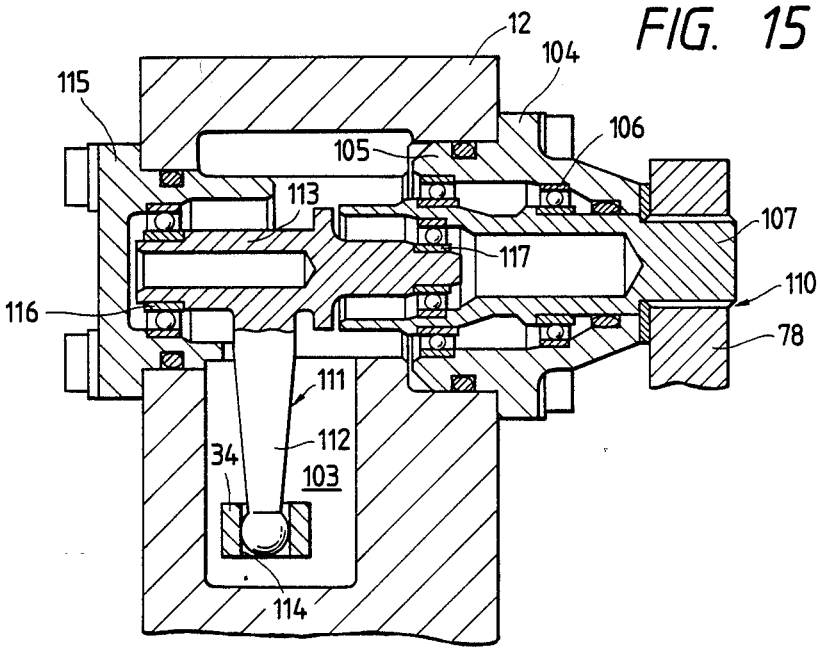
FIG. 15 is an enlarged sectional view as seen in the line XV—XV of FIG. 13.
Figure 16A:
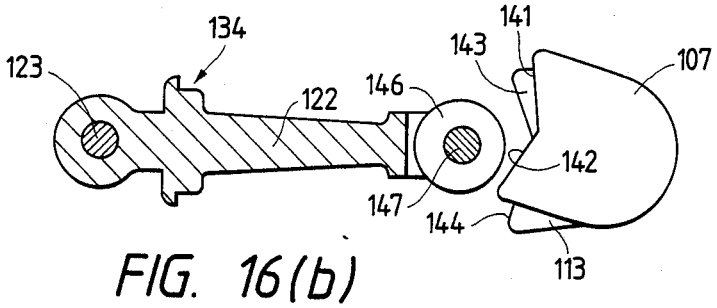
FIG. 16(*a*) to FIG. 16(*d*) are explanatory diagrams for illustrating the operation of the device of FIG. 13.
Figure 16B:
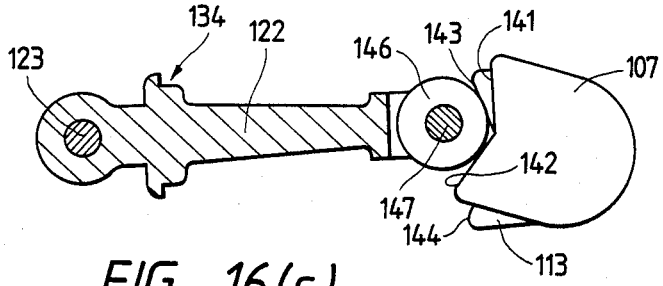
Figure 16C:
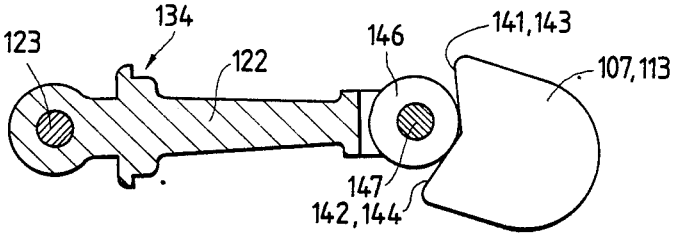
Figure 16D:
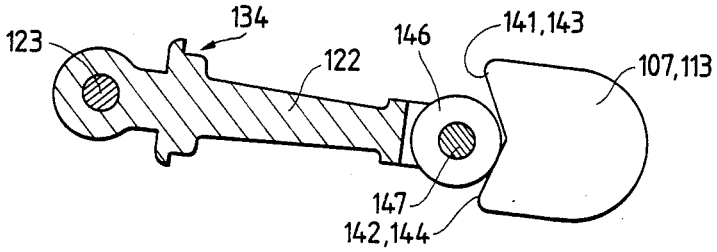
Figure 17:
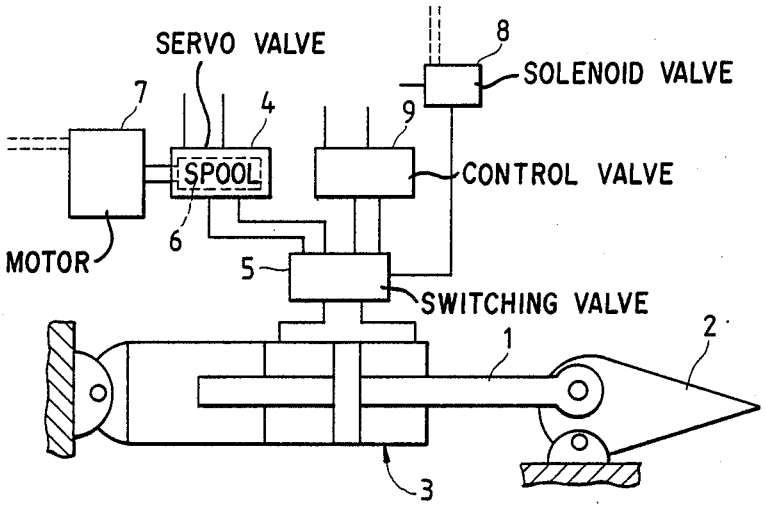
FIG. 17 PRIOR ART
FIG. 17 is a schematic overall diagram explaining the prior art neutral position resetting device.

FIG. 13 to FIG. 15 illustrate servo actuator 11 that may be used in an aircraft and the like. The servo actuator 11 has a piston 14 which is slidably enclosed within a chamber 13 of the casing 12. The piston 14 partitions the chamber 13 into a first chamber 15 and a second chamber 16. The piston 14 has a piston rod 17 that penetrates through a cap 18 screwed into the casing 12. The tip of the piston rod 17 is coupled with a movable airfoil 20 rotatably supported by a fuselage 19. Reference numeral 21 is a position detector that detects the position of the piston 14. The servo actuator 11 is servo-controlled by a feedback signal from the position detector 21. Reference numerals 101 and 102 are a supply passage and a discharge passage, respectively, provided in the casing 12. The discharge passage 102 has a spacious chamber 103 in its path. One end of the supply and discharge passages 101 and 102 are connected to a pressurized oil source and a tank, respectively, which are not shown in the drawings, while the other end of the respective passages are connected to the servo control valve 26 enclosed within the casing 12. The servo control valve 26 has a sleeve 30 in which a first, second and third ports 27, 28 and 29, respectively, are disposed. Within the sleeve 30 there is slidably housed a spool 34, which has three lands 31, 32 and 33. The first port 27 and the second chamber 16, and the third port 29 and the first chamber 15, are connected by passages 43 and 44, respectively.

Reference numeral 35 indicates a motor which has a moving piece 36 coupled with the spool 34. The moving piece 36 of the motor 35 is moved in the axial direction by an electrical signal sent from the cockpit of the aircraft. Moving piece 36 functions to move the spool 34 in the axial direction to control the quantity and the direction of pressurized oil to be supplied to the servo actuator. Here, the direction of motion of the spool 34 and the direction of motion of the piston 14 are mutally opposed.

Reference numeral 104 is a supporting body fixed to the casing 12, and the supporting body 104 rotatably supports a shaft 107 via a pair of bearings 105 and 106. One end of a second lever 78, which is arranged within the chamber 103, is fixed to the outer end of the shaft 107. A first lever 75 is coupled to one end of the shaft 107 via a pin 108. A connection bar 74 fixed to the tip of the piston rod 17 is coupled to the first lever 75 via a pin 109. The shaft 107 and the second lever 78 constitute a first link 110 whose one end is coupled to the piston 14 via the first lever 75 and the connection bar 74. The first link 110 can rock with its other end, namely, the shaft 107 as the center of rocking.

Reference numeral 111 shows a second link disposed within the chamber 103. The second link 111 has a link part 112 that extends substantially parallel to the second lever 78 and a shaft part 113 that is formed integrally with the other end of the link part 112 and perpendicularly to the link part 112. One end of the link part 112 is inserted to a square cavity 114, and by so doing, one end of the second link 111 is coupled with the spool 34. The shaft part 113 is rotatably supported by a supporting body 115 and the shaft 107 via bearings 116 and 117. As a result, the second link is coupled to the spool 34 in its one end part, and is rockable with the other end part, namely, the shaft part 113 as the center of rocking. The rocking centers of the first and second links 110 and 111 are arranged coaxially.

Reference numeral 118 is a hole communicating with the chamber 103 formed in the casing 12 and parallel to the spool 34. The mouth of the hole 118 is closed by a cover 119. An opening 120 formed in the cover 119 and the hole 118 are slidably engaged with the rear end part and the central part of a slider 121. The center axis of the slider 121 intersects perpendicularly with the rocking axis of the first and second links 110 and 111. A movable rod 122 which extends toward the first and second links 110 and 111 is attached via a pin 123 to the slider 121. By this arrangement, the movable rod 122 can be rocked slightly in the direction of extension of the first and second links 110 and 111 with the pin 123 as the center of rocking.

Reference numeral 124 is a spring shoe which is locked to the hole 118. Between the spring shoe 124 and the movable rod 122 there is interposed a spring 125 that energizes the slider 121 and the movable rod 122 toward the covering, separating them under normal conditions from the other ends of the first and second links 110 and 111. In addition, the spring 125 holds the movable rod 122 on the straight line that joins the pin 123 to the rocking axis of the first and second links 110 and 111.

Reference numeral 131 is a solenoid valve attached to the casing 12 and actuated when the control of the servo actuator 11 by the servo control valve 26 becomes inoperative. Oil pressure is continually applied to the solenoid valve 131 through a passage 132 that is connected to the supply passage 101. A passage 133 connects the solenoid valve 131 and the opening 120. Oil pressure is supplied through the passage 133 only when the solenoid valve 131 is actuated, although no oil pressure is supplied under normal conditions. A pusher 134 including the slider 121 and the movable rod 122 is normally separated from the first and second links 110 and 111 by being pushed by the spring 125, but when oil pressure is supplied to the opening 120 through the passage 133 as a result of the actuation of the solenoid valve 131, it is moved straight toward the other end parts of the first and second links 110 and 111. In the other end part of the first link 110, namely, the inner end part of the shaft 107 in this embodiment, two engaging surfaces 141 and 142 inclined in the direction opposite to that of extension of the second lever 78 are disposed as shown in FIG. 16(*a*). Further, in the other end part of the second link 111, namely, the inner end part of the shaft part 113 in this embodiment, two engaging surfaces 143 and 144 are provided which are inclined in the direction opposite to that of extension of the link part 112.

In the tip part adjacent to the first and second links 110 and 111 of the movable rod 122, a roller 146 is rotatably supported with a pin 147. When the pusher 134 moves straight toward the first and second links 110 and 111, the roller 146 can engage with either one of the engaging surfaces 141, 142, 143, and 144. When the solenoid valve 131 is actuated, the first and second links 110 and 111 and the pusher 134 constitute reset means 148 for applying a driving force to the spool 34 of the servo control valve, forcing it to be moved in the direction to reset the piston 14 of the servo actuator 11 to the neutral position.

The operation of this embodiment of the device will now be described.

When the servo actuator 11, servo control valve 26, motor 35 and others are operating normally and the aircraft is flying smoothly, the solenoid valve 131 is not actuated so that the pusher 134 is separated from the first and second links 110 and 111 by being pushed by the spring 125, and the first and second links 110 and 111 are located at the rocking positions corresponding to the positions of the piston 14 and the spool 34. If in this state there arises the necessity of rocking the movable airfoil 20 upward, for example, the spool 34 is moved toward the second link 111 by sending a signal from the cockpit to the motor 35. By this action, oil pressure supplied from a pressurized oil source is supplied to the second chamber 16, and the piston rod 17 is retracted by moving in the direction opposite to the moving direction of the spool 34. In this case, the servo link 111 is rocked slightly in the counterclockwise direction in FIG. 13 by being pushed by the spool 34.

During the above operation, if the control of the servo actuator 11 by means of the servo control valve 26 becomes inoperative due to, for example, a failure of the motor 35, a warning lamp in the cockpit lights up. At this time, the spool 34 of the servo control valve 26 is reset to the neutral position by the action of a centering spring built in the motor 35. Next, when a signal is sent from the cockpit to the solenoid 131 to actuate the solenoid, pressurized oil in the supply passage 101 is supplied to the opening 120 through the passages 132 and 133. As a result, the pusher 134 advances straight toward the first and second links 110 and 111 while compressing the spring 125. Because of such a straight motion, the roller 146 of the pusher 134 approaches the engaging surfaces 141, 142, 143 and 144 of the first and second links 110 and 111. Since the piston rod 17 is retracted within the casing 12, as mentioned earlier, and the spool 34 is reset to its neutral position. The shaft 107 and the shaft part 113 are at their respective rocking positions, as shown in FIG. 16(*a*). As a result, the roller 146 engages first with the engaging surface 142 of the first link 110.

As the pusher 134 advances further in this state, the movable rod 122 is capable of making fine rocking motions in the counterclockwise direction under a reaction received from the Ongaging surface 142, and engages with both of the engaging surface 142 of the first link 110 and the engaging surface 143 of the second link 111 as shown in FIG. 16(*b*). Therefore, the roller 146 pushes both of the engaging surfaces 142 and 143. However, the first link 110, which has the engaging surface 142, cannot rock because its piston 14 is fluid-locked. Therefore, the pusher 134 pushes the engaging surface 143 and causes the second link 111 to rock until the engaging surface 143 coincides with the engaging surface 141 of the first link 110. As a result, the spool 34 recieves a driving force from the rocking second link 111, and is thereby forced to move in the direction to reset the piston of the servo actuator 11 to the neutral position, corresponding to the direction of the motor 35. Because of this action, pressurized oil is supplied to the first chamber 15 of the servo actuator 11, and the piston 14 is moved toward the neutral position.

As a result of the movement of the piston 14, the first link 110 is rocked in the counterclockwise direction, and the pusher 134 is pushed back slightly toward the initial position by the engaging surface 141 of the first link 110. With such a motion of the pusher 134, the spool 34 of the servo control valve 26 can move and approach the neutral position by means of the centering spring of the motor 35. Therefore, the size of the opening of the servo control valve 26 is reduced. At this time, the second link 110 is moved slightly in the direction opposite to that described above by being pulled by the spool 34. When the piston 14 of the servo actuator 11 is reset to the neutral position as shown in FIG. 13, all of the intersecting angles between the extension direction of the movable rod 122 and the engaging surfaces 141, 142, 143 and 144 become substantially equal. Further, the spool 34 of the servo control valve 26 is reset to the neutral position. When the servo actuator 11 is reset to the neutral position, the movable airfoil arrives at a position which does not adversely affect the flight. Contrary to the above case, namely, when the control by the servo control valve 26 becomes inoperative in the state where the piston 14 is extended, the roller 146 causes the second link 111 to be rocked until the engaging surface 144 coincides with the engaging surface 142. By this motion, the spool 34 is forced to move in the direction to approach the second link 111, and the piston 14 is reset to the neutral position.

The present embodiment was described in conjunction with the case in which there are provided engaging surfaces 141, 142, 143 and 144 on the distal ends of the first and second links 110 and 111, and there is provided a roller 146 as an engaging part on the tip of the pusher 134. However, it may be arranged to provide engaging parts such as rollers on the other ends of the first and second links, along with the engaging surface provided on the tip of the pusher. Further, in this embodiment, the neutral position of the piston 14 is at the middle in the axial direction of the casing 12 so that there are provided engaging surfaces 141 and 142, and 143 and 144, inclined in opposite directions, on the other end of the first and second links 110 and 111, respectively. However, for the case where the neutral position is at either one of the stroke ends of the piston, or for the case where the actuator resets to the neutral position only when the piston is moved to one side of the neutral position, whereas the resetting motion is unnecessary when it is moved to the other side, only engaging surfaces that extend in the same direction, or engaging parts on the other ends of the first and second links are required. In such a case, the slider 121 and the movable rod 122 that constitute the pusher 134 may be integrally formed.

As described above, and in accordance with the teachings of the present invention, the construction of the device can be simplified and reduced in size and weight. Further, the manufacturing cost can be cut. Further, in the case where a failure in the system is caused by impact of a foreign object by the spool of the servo control valve, the foreign object can be crushed by the movement of the spool in the axial direction, so that the servo control valve can be returned automatically to its normal position.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the applicants' general inventive concept.

What is claimed is:

1. An apparatus for resetting a servo actuator from an actuated position to a neutral position, comprising:

actuator valve means in fluid communication with the servo actuator for supplying pressurized fluid from a fluid source to move the servo actuator between the actuated position and the neutral position, said actuator valve means including a spool, having a first position wherein said pressurized fluid is supplied to move the servo actuator from the neutral position to the actuated position, and having a second position wherein said pressurized fluid is supplied to move the servo actuator from the actuated position to the neutral position; and reset means configured to allow passage of said pressurized fluid therethrough from said fluid source to said actuator valve means both when said spool is in said first position and when said spool is in said second position, said reset means being responsive to a malfunction of said actuator valve means at times when the servo actuator is in the actuated position, for moving said spool from said first position to said second position to cause the servo actuator to move from the actuated position to the neutral position.

2. The apparatus of claim 1, wherein said reset means includes:

a piston slidably disposed in a substantially cylindrical chamber, which is moved upon occurrence of the malfunction of said actuator valve means;

a first reset pawl connected to said piston; and a second reset pawl engaged with the first reset pawl at times when said piston slides in said chamber, wherein at least one of said first and second reset pawls abuts upon said spool of said actuator means for moving said spool from said first position to said second position.

3. The apparatus of claim 1, wherein said reset means includes a pair of pistons disposed to be moved upon occurrence of the malfunction of said actuator valve means, and wherein at least one of said pistons abuts upon the spool of said actuator valve means for applying a driving force against the spool.

4. The apparatus of claim 1, wherein said reset means includes a pusher having a projecting tip disposed to extend upon occurrence of the malfunction of said actuator valve means, and a link having two ends, wherein one end of said link is coupled to the spool of said actuator valve means, thereby providing an engaging surface on one of the projecting tip of said pusher and the other end of said link, and providing an engaging part that engages with the engaging surface on the other, and when said pusher is extended, a driving force is applied to the spool by causing said engaging surface to engage with said engaging part and by causing said link to rock by the driving force of said pusher.

5. An apparatus for resetting a servo actuator from an actuated position to a neutral position, comprising:

actuator valve means in fluid communication with the servo actuator for supplying pressurized fluid from a fluid source to move the servo actuator between the actuated position and the neutral position, said actuator valve means including a spool, having a first position wherein said pressurized fluid is supplied to move the servo actuator from the neutral position to the actuated position, and having a second position wherein said pressurized fluid is supplied to move the servo actuator from the actuated position to the neutral position; and reset means responsive to a malfunction of said actuator valve means at times when the servo actuator is in the actuated position, for moving said spool from said first position to said second position to cause the servo actuator to move from the actuated position to the neutral position, including a piston slidably disposed in a substantially cylindrical chamber, which is moved upon occurrence of the malfunction of said actuator valve means, a first reset pawl connected to said piston, and a second reset pawl engaged with said first reset pawl upon the sliding of said piston in said chamber, wherein at least one of said first and second reset pawls abuts upon said spool of said actuator valve means, for moving said spool from said first position to said second position.

6. An apparatus for resetting a servo actuator from an actuated position to a neutral position, comprising:

actuator valve means in fluid communication with the servo actuator for supplying pressurized fluid from a fluid source to move the servo actuator between the actuated position and the neutral position, said actuator valve means including a spool, having a first position wherein said pressurized fluid is supplied to move the servo actuator from the neutral position to the actuated position, and having a second position wherein said pressurized fluid is supplied to move the servo actuator from the actuated position to the neutral position; and reset means responsive to a malfunction of said actuator valve means at times when the servo actuator is in the actuated position, for moving said spool from said first position to said second position to cause the servo actuator to move from the actuated position to the neutral position, including a pair of pistons disposed to be moved upon occurrences of said malfunction of said actuator valve means, for applying a driving force against the spool.

7. An apparatus for resetting a servo actuator from an actuated position to a neutral position, comprising:

actuator valve means in fluid communication with the servo actuator for supplying pressurized fluid from a fluid source to move the servo actuator between the actuated position and the neutral position, said actuator valve means including a spool, having a first position wherein said pressurized fluid is supplied to move the servo actuator from the neutral position to the actuated position, and having a second position wherein said pressurized fluid is supplied to move the servo actuator from the actuated position to the neutral position; and reset means responsive to a malfunction of said actuator valve means at times when the servo actuator is in the actuated position, for moving said spool from said first position to said second position to cause the servo actuator to move from the actuated position to the neutral position, including a pusher having a projecting tip, disposed to extend upon occurrence of the malfunction of said actuator valve means, and a link having two ends, wherein one end of said link is coupled to the spool of said actuator valve means, thereby providing an engaging surface on one of the projecting tip of said pusher and the other end of said link, and providing an engaging part that engages with the engaging surface on the other, and when said pusher is extended, a driving force is applied to the spool by causing said engaging surface to engage with said engaging part and by causing said link to rock by the driving force of said pusher.

* * * * *